United States Patent [19]

Johnson

[11] Patent Number: 4,551,614

[45] Date of Patent: Nov. 5, 1985

[54] ELECTRICAL RESISTANCE HEATER UNIT

[76] Inventor: Joe P. Johnson, 113 Cypress Dr., Inman, S.C. 29349

[21] Appl. No.: 630,847

[22] Filed: Jul. 13, 1984

[51] Int. Cl.[4] ..... F24H 3/00; H05B 1/00; H01C 3/10; H01C 7/22

[52] U.S. Cl. ..... 219/355; 219/352; 219/342; 338/283; 338/280

[58] Field of Search ..... 219/355, 352, 353, 354, 219/357, 345, 342, 356; 338/283, 287, 280

[56] References Cited

U.S. PATENT DOCUMENTS

| | | | |
|---|---|---|---|
| 1,695,860 | 10/1928 | Rohn | 219/548 |
| 2,682,596 | 6/1954 | Cox et al. | 201/69 |
| 2,857,499 | 10/1958 | Fearn | 219/19 |
| 3,327,093 | 6/1967 | Hager et al. | 219/349 |
| 3,342,977 | 9/1967 | Anderson | 219/548 |
| 3,431,705 | 3/1969 | Schmermund | 53/388 |
| 3,471,680 | 10/1969 | Kelm | 219/342 |
| 3,525,850 | 8/1970 | Hager | 219/357 |
| 3,757,083 | 9/1973 | Dietz et al. | 219/356 |
| 3,763,349 | 10/1973 | Desloge | 219/536 |
| 4,100,395 | 7/1978 | Ballard | 219/345 X |
| 4,262,190 | 4/1981 | Hager, Jr. | 219/355 X |

FOREIGN PATENT DOCUMENTS

| | | | |
|---|---|---|---|
| 975038 | 9/1948 | France | 15/2 |

*Primary Examiner*—C. L. Albritton
*Assistant Examiner*—M. M. Lateef
*Attorney, Agent, or Firm*—Luke J. Wilburn, Jr.

[57] ABSTRACT

An improved high intensity electricl resistance heater unit comprising one or more elongate thin metal foil ribbons adapted to be heated to a high temperature by passage of electricity therethrough, a thermally insulating rigid backing for supporting each ribbon, the backing having an elongate channel in a front face thereof for receiving the ribbon with side edges of the channel being undercut to form side grooves to receive and contain longitudinal side edge portions of the ribbon to support the same along the length of the channel while leaving the major surface of the ribbon unobstructed for heat radiation therefrom. A plurality of ribbons may be mounted in the backing with all electrical metal connectors being shielded within the backing from exposure on the back face of the backing material. The ribbons may be transversely corrugated and the configuration, e.g., amplitude, of the corrugations varied along the length of the ribbons to vary the heat output along the length of the heater unit, if desired.

11 Claims, 5 Drawing Figures

ELECTRICAL RESISTANCE HEATER UNIT

The present invention relates to an improved electrical resistance radiant heater unit, and, more particularly, to such a heater unit having improved means for supportably mounting elongate metal foil ribbon heating elements of the unit to a thermally insulating backing material.

BACKGROUND OF THE INVENTION

High output, quick response, electrical radiant heaters having heating elements in the form of thin corrugated metal foil ribbons are well known. Such metal foil ribbon heaters have a low thermal inertia and are particularly suited for employment in situations requiring high temperature, rapid heating of objects with quick cooling and low retention of heat in the heater unit when it is cut off, as when a moving line of objects are stopped temporarily in front of the heater and overheating is to be avoided. The metal foil ribbon heating elements generally are comprised of very thin corrugated metal strips, such as "Inconel" metal, and are mounted on a thermally insulating backing material, such as a ceramic block, with the exposed face of the ribbon directed toward the object or objects to be heated. Such heater units are suitably connected to a power source and generally are supported above or alongside a path of moving material, such as a moving sheet, web, or fabric, to heat the same.

One such radiant heater construction is described in U.S. Pat. No. 3,525,850, the disclosure of which is incorporated herein by reference. As described in the patent, an electrical resistance, corrugated metallic foil ribbon adapted to be heated by electricity to a temperature in the range of about 1200° to 1800° F. is backed by a thermally insulating backing, preferably a ceramic material, having a thermal conductivity at 1500° F. in the range of about 0.07–0.15 B.t.u./hr.-ft.-°F. The backing may be made of an assemblage of blocks to minimize warping or fracturing at high temperatures of operation of the heater.

Difficulties have been experienced in maintaining the structural integrity of the thin foil ribbon heaters due to several factors. Longitudinal elongation occurs in the thin metal ribbons during heating, causing the foil ribbons to droop and sag away from the insulating backing at high temperatures, resulting in uneven heating of the objects being heated. In addition, the thin ribbon elements frequently burn out when hot spots occur in the ribbons. U.S. Pat. No. 3,525,850 attemps to overcome the problems by employing fastening means composed of heat conductive wires, nails or pins spaced along the length of the ribbons to hold the ribbons to the thermally insulating backing, with the metal fastening elements extending through the insulating back to the rear side thereof to convey excess heat away from the foil ribbon at their points of contact with the fastners.

The use of wires, pins, and clamps along the length of the ribbons restricts free longitudinal expansion and contraction of the same. Such pins, clamps and wires also wear the foil ribbons at their points of contact, cutting into the thin edges of the metal foil and consequently decreasing the life of the heating element. Because the metal fasteners as described in U.S. Pat. No. 3,525,850 extend through to the rear side of the insulating material to dissipate heat, there is a heat loss and consequently loss in the effeciency of the heater unit.

Further, exposure of electrically conductive metal wires, clamps, and pins on the back of the thermally insulating backing material creates electrical shock and fire hazard if the fasteners are contacted by foreign objects and materials, such as lint, dust or debris which may fall into or occur around the heating unit.

BRIEF OBJECTS OF THE PRESENT INVENTION

It is therefore an object of the present invention to provide an improved high intensity electrical resistance heater unit employing thin metal foil ribbons as the heating elements which overcomes a number of the problems of the prior art.

It is a more specific object to provide a high intensity electrical resistance heater unit having improved means for mounting the thin metallic foil ribbon heating elements of the heater on a thermally insulating backing material.

SUMMARY OF THE INVENTION

The present invention comprises a high intensity electrical resistance radiant heater unit having a thermally insulating rigid backing on which is mounted one or more elongate thin metal foil ribbons adapted to be heated by passage of electricity therethrough to a high temperature for radiant discharge of heat therefrom. The ribbons are supportably mounted in channels in the front face of the backing, side edges of which are undercut to form side grooves for receiving the longitudinal side edge portions of the ribbons to frictionally support and retain the same along their length while leaving the major surface of the ribbons unobstructed by support means to permit unrestricted heat radiation therefrom. The insulating backing material further encloses the electrical connectors of the ribbons to insulate and isolate the heating elements completely from exposure on the rear face of the backing, thus minimizing electrical shock, fire hazard and heat loss from the heater unit.

BRIEF DESCRIPTION OF THE DRAWINGS

The above as well as other objects of the invention will become more apparent and the invention will be better understood from the following detailed description of preferred embodiments, when taken together with the accompanying drawings, in which.

DESCRIPTION OF THE PREFERRED EMBODIMENTS

Referring to FIGS. 1–4, the heating unit 10 of the present invention includes a rigid heat insulating backing material 12 and one or more heating elements comprised of thin metallic foil ribbons 14 mounted on a front face of the backing material. The thermally insulating backing material 12 is of low heat and electrical conductivity and highly resistant to high temperatures. The backing material may be formed of suitable materials, such as cellular asbestos cement compositions, glass fiber compositions, mineral wool, and various ceramic products, such as blocks of Johns Manville "Maronite Type C" calcium silicate. The thickness of the backing material may be varied to provide the desired thermal insulating properties for the heater unit. Other backing materials as described in U.S. Pat. No. 3,525,850 may be employed in the heater unit construction of the present invention.

The metallic foil ribbons 14 of the unit may be made of suitable metal to provide a high temperature, electrical resistance radiant heating. Typically the foils may be of a stainless steel type, certain of which are sold under the names Hastelloy, Inconel, Waspalloy, and other cobalt-chromium-nickel class refractory alloys. The thickness of the foil ribbons may vary from about 0.0005 inch to about 0.01 inch, and preferably maybe about 0.002 inch. The ribbons may be of various lengths, and typically may be from about 1 to 2 inches wide, depending upon the particular application and length of heating unit desired. The materials employed for the metal foil ribbon heating elements may be as described in aforesaid U.S. Pat. No. 3,525,850, with requisite properties to produce a temperature in the range from about 1200° to 1800° F.

Figure 1:
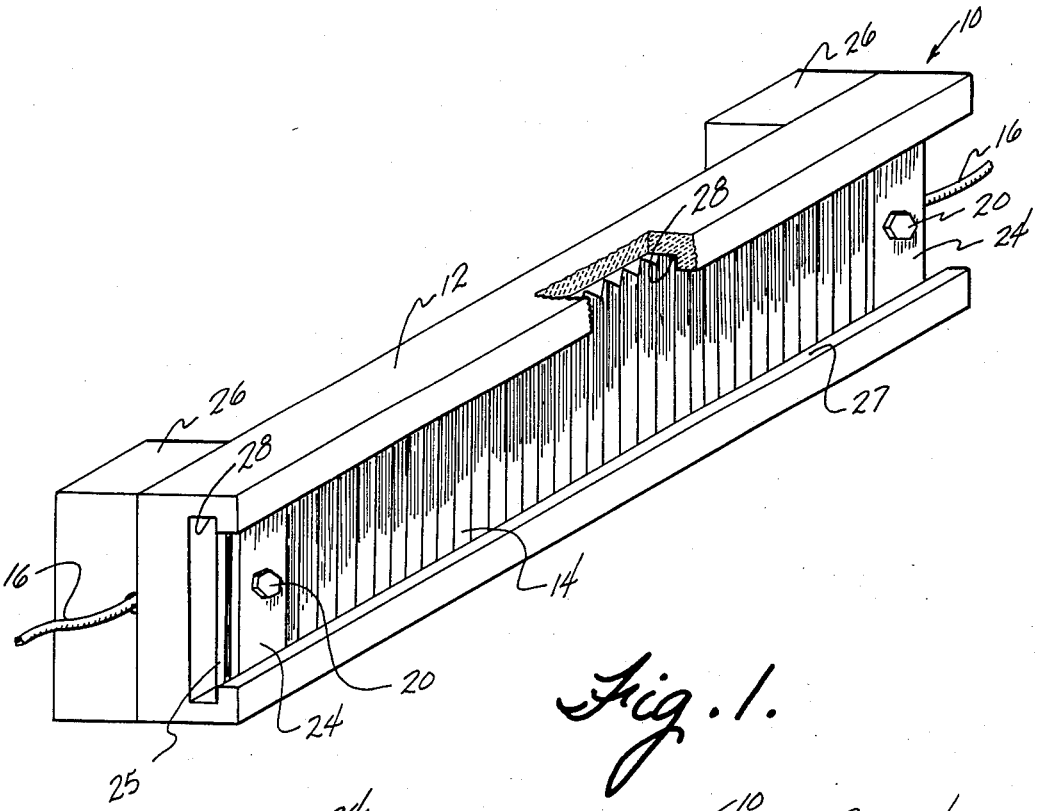
FIG. 1 is a perspective view of a high intensity heater unit of the present invention, showing the mounting of a single metal foil ribbon heating element on a thermally insulating backing material.
Figure 2:
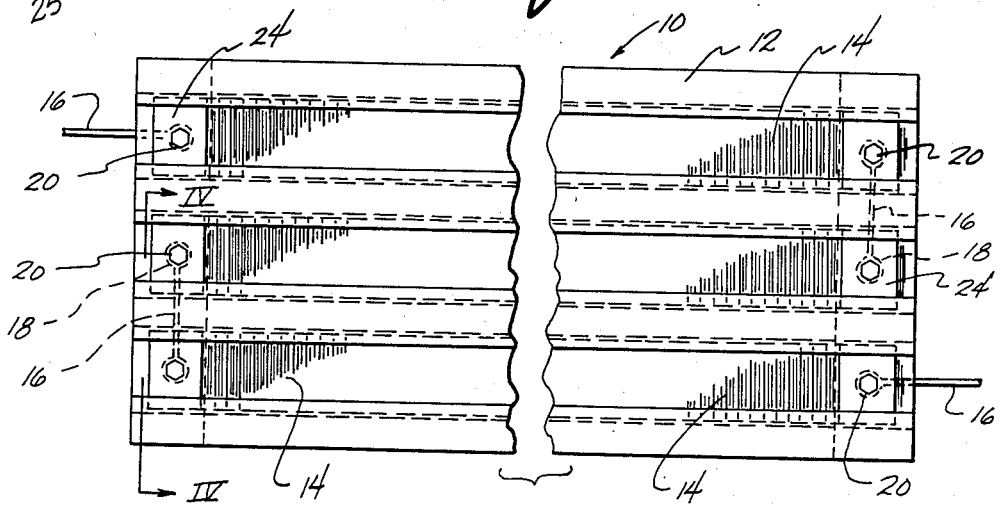
FIG. 2 is a plan view of the front face of another heater unit of the present invention, showing the mounting of multiple metal foil ribbon heating elements on a thermally insulating backing material.
Figure 3:
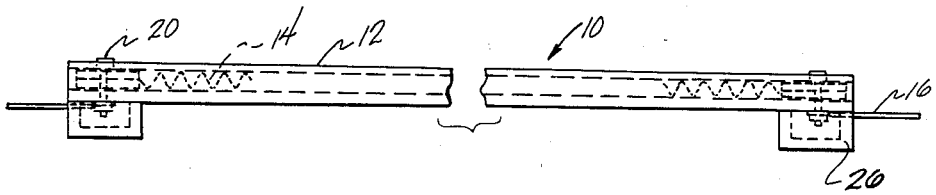
FIG. 3 is a bottom side elevation view of the heater unit of FIG. 2.
Figure 4:
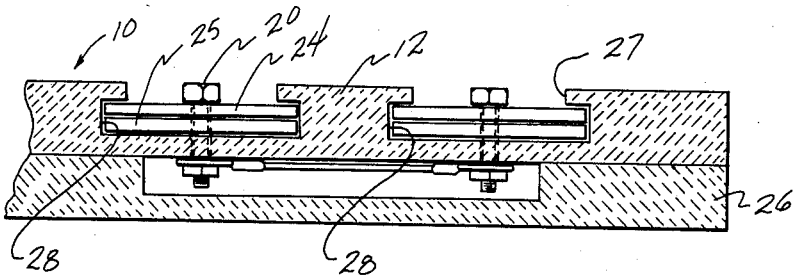
FIG. 4 is an enlarged sectional view of a portion of the heater unit of FIG. 2, taken along line IV—IV of FIG. 2 and looking in the direction of the arrows.

As seen in FIGS. 2 and 4, adjacent ends of the metal foil ribbons 14 of the multiple ribbon heater units are interconnected in series by suitable electrically conducting wires 16 attached by metal eyelets 18 to metal terminal posts 20 which have fastening nuts 22 to secure the ends of the foil ribbons 14 between a pair of thin metal plates 24, 15. The terminal posts 20 and connecting wires 16, as seen in the figures, extend into the backing material 12 and are enclosed by an additional backing block 26 at the ends of the heater unit 10, such that no electrically conductive metal is exposed on the rear face of the backing, thus providing increased protection against electrical shock and fire hazards, and reducing the heat loss of the heater unit from the back of the insulating material.

As aforementioned, the thin metal foil ribbons elongate in longitudinal length at high temperatures and correspondingly contract in length when they cool. Therefore, unless the ribbons are supported along and intermediate their length, high temperature causes the ribbons to sag and droop away from the support backing, causing sections of the heating ribbon to more closely approach the objects being heated and resulting in corresponding uneven heating of the objects.

To adequately support the foil ribbons while permitting free longitudinal contraction and elongation of the same under conditions of use, the rigid ceramic insulating backing material is provided with elongate channels 27 cut into the front face of the same. The side edges of each of the channels in the ceramic backing material are undercut to form grooves 28 for receiving the corresponding longitudinal side edges of a foil ribbon to frictionally retain and support the ribbon along its full length in the backing material. For transversely corrugated foil ribbons, the height of the grooves are dimensioned to closely contain the same therein while permitting some movement of the ribbon during elongation and contraction as it is heated and cooled by application and removal of electrical current therefrom.

It can thus be seen that the provision of recessed channels 27 with undercut side grooves 28 in the backing 12 for reception and support of the side edges of the foil ribbons 14 prevent sag or droop of the ribbons away from the backing which causes uneven heating of the objects being heated. In addition, the absence of metallic support elements, such as wires, pins or clamps, along the length of the ribbons reduces the chances of hot spots developing in the ribbons which can damage the ribbons due to burn out in localized areas. The absence of metal fastening pins, wires and clamps also eliminate wear of the same on the ribbons which heretofore have caused cutting or tearing of the ribbons. While substantially the full face of the foil ribbon is exposed directly for radiant projection of heat onto the objects to be heated, the ribbons are recessed below the face of the insulating backing material to shield them from contact with objects being heated or with foreign objects which may be in the heating area.

Although the improved channel support means of the present heater unit is shown in the drawings to be employed with corrugated metal foil ribbons to support the same, the grooved channel support configuration also may be used to receive and satisfactorily support flat metal foil ribbons when used as the heating elements of the heater unit.

Figure 5:
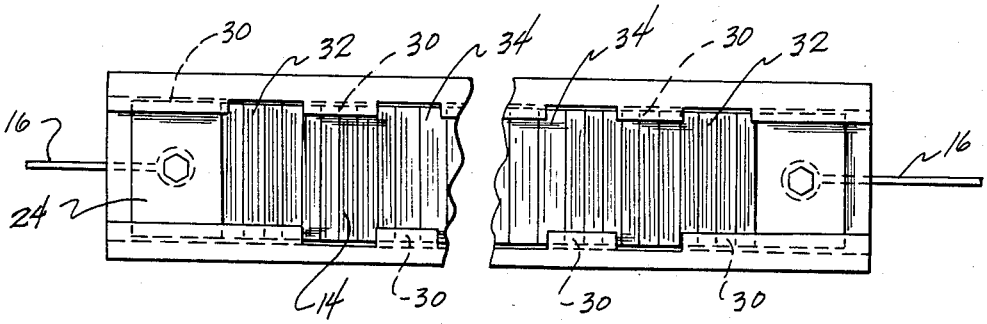
FIG. 5 is a modified form of a single foil ribbon heater unit as seen in FIG. 1.

FIG. 5 shows a modified form of the invention wherein each undercut side edge groove 30 of the channel 27 may be discontinuous along the length of the channel, and staggered with respect to the opposite groove, so as to be spaced along the longitudinal length of the channels to contain and support the side edges of the ribbons and prevent droop and sag of the same during elongation and contraction in normal use.

As also illustrated in FIG. 5, the corrugations in the ribbon 14 of the heater units of the present invention may be varied, e.g., in amplitude, in frequency of repeat, along the length of the channels to correspondingly vary the heat output of the heater unit along their length. For example, if a greater radiant heat output is required at the ends of the heating ribbon than in the middle, as where the heater may extend across a moving web or fabric and more heat is desired at the fabric edges, the amplitude or the frequency of repeat of the corrugations may be varied to place more metal per unit length of the heater at the ends 32 of the ribbon than in the center 34 to provide higher output of radiant heat therefrom.

The clearance of the grooves 28 of the channels 27 with the ribbons may be varied to ensure their retention in the channels without droop or sag while permitting elongation and contraction of the same during use. Typically, grooves which are approximately 1/16 inch greater in height than the height or thickness of the corrugated or flat ribbon, and about 0.05 inch wider than the width of the ribbons have been found to effectively support and retain the same in use.

That which is claimed is:

1. An improved high intensity electrical resistance heater unit comprising an elongate thin metal foil ribbon adapted to be heated by passage of electricity therethrough to a high temperature for radiation of heat therefrom, a thermally insulating rigid backing of low electrical conductivity for supporting said ribbon, said backing having an elongate channel formed in a front face thereof for receiving the ribbon, sides of the channel being undercut to form side grooves, and longitudinal side edge portions of the ribbon being received in said side grooves of the channel to frictionally support and retain the ribbon along its length within the channel while leaving the major surface of the ribbon unobstructed to permit unrestricted heat radiation therefrom.

2. The heater unit of claim 1 including means attached to each end of the ribbon for connecting the ribbon to a source of electricity, said connecting means being mounted in said backing so as to be unexposed on the rear face of the backing.

3. The heater unit of claim 1 wherein said backing includes a plurality of said channels with undercut side edges each supportably receiving a said ribbon to support the same by frictional engagement along longitudinal side edges, and means electrically connecting adjacent ends of adjacent ribbons on said backing to electrically interconnect the ribbons in series, said means connecting adjacent ends of the ribbons being mounted on said backing in unexposed relation to the rear face of the backing.

4. The heating unit of claim 1 wherein said ribbon is corrugated transversely to its length with the longitudinal corrugated edge portions of the ribbon residing in said side grooves, and with the surface of the ribbon residing within the channel below the face of the insulating backing to protect the same against contact with materials to be heated.

5. The heater unit of claim 4 wherein the side grooves are continuous along the length of the channel.

6. The heater unit of claim 4 wherein the corrugations in the ribbon vary along its length to provide corresponding variations in heat output from the heater unit at selected points along the longitudinal length of the channel.

7. The heating unit of claim 1 wherein the grooves are discontinuous along the length of the channel.

8. The heater unit of claim 1 wherein the insulating backing comprises one or more blocks of ceramic material.

9. The heater unit of claim 1 wherein the rear face of the backing has an absence of electric and heat conductive metal components.

10. An improved high intensity electrical resistance heating unit comprising an elongate thin transversely corrugated metal foil ribbon adapted to be heated by passage of electricity therethrough to a high temperature for radiation of heat therefrom, a thermally insulating rigid backing of low electrical conductivity for supporting said ribbon, means formed in the backing for receiving and longitudinally supporting side edge portions of the ribbon continuously along its length to retain the ribbon against the backing without droop or sag and permit longitudinal extension and contraction of the ribbon along its length, and said corrugations in the ribbon vary along the length of the ribbon to correspondingly vary the heat output from the heater unit along the longitudinal length of the ribbon.

11. A heater unit as defined in claim 10 wherein said means for retaining the ribbon against the backing comprises an elongate channel in the front face of the backing receiving the ribbon with the corrugations of the ribbon contained within the channel depth to recess the ribbon therein and protect it against contact with foreign materials and objects heated by the heater unit.

* * * * *